US005542964A

United States Patent [19]

Kroeger et al.

[11] Patent Number: 5,542,964

[45] Date of Patent: Aug. 6, 1996

[54] METHOD OF AIR PURIFICATION

[75] Inventors: Arnold C. Kroeger; Curt J. Lawnicki; Arthur E. McIvor, all of Tampa, Fla.

[73] Assignee: CRS Industries, Inc., Tampa, Fla.

[21] Appl. No.: 471,773

[22] Filed: Jun. 6, 1995

Related U.S. Application Data

[60] Continuation of Ser. No. 375,424, Jan. 18, 1995, abandoned, which is a division of Ser. No. 22,908, Feb. 26, 1993, Pat. No. 5,401,299.

[51] Int. Cl.[6] ..... B03C 3/68

[52] U.S. Cl. ..... 95/6; 95/7; 96/23; 323/903; 361/235

[58] Field of Search ..... 96/80, 82, 22–24; 95/6, 7, 80, 81; 323/903; 361/226, 233, 235

[56] References Cited

U.S. PATENT DOCUMENTS

| | | | |
|---|---|---|---|
| 4,860,149 | 8/1989 | Johnston | 323/903 X |
| 5,061,296 | 10/1991 | Sengpiel et al. | 95/7 |
| 5,255,178 | 10/1993 | Liberati | 96/80 |
| 5,401,299 | 3/1995 | Kroeger et al. | 96/23 |

*Primary Examiner*—Richard L. Chiesa
*Attorney, Agent, or Firm*—Finnegan, Henderson, Farabow, Garrett and Dunner

[57] ABSTRACT

Air purification system where air is subjected to complex electrical field resulting from a DC voltage and AC frequency in kilovolt and kilohertz range respectively, applied to screen assembly in air path. DC amplitude and AC frequency self regulate to selected parameters. Parameters are selectable independently of one another.

9 Claims, 8 Drawing Sheets

METHOD OF AIR PURIFICATION

This application is a continuation of application Ser. No. 08/375,424 filed Jan. 18, 1995, now abandoned, which in turn is a divisional application Ser. No 08/022,908, filed on Feb. 26, 1993now U.S. Pat. No. 5,401,299.

BACKGROUND OF THE INVENTION

1. Field of Invention

The present invention related to air purification systems and related method and more particularly to an air purification system of the type that enhances filtration by subjecting airborne contaminants to complex electrical fields.

2. Discussion of Related Art

Air purification systems of the type under consideration include a fixed output power generator that produces a high voltage (HV) direct current and/or a high frequency (HF) alternating current. The HV and HF output from the power generator is fed to separate electrodes. In large installations, electrodes are installed in an air handling plenum, between the mixing box and cooling coils. In operation, the HV and HF outputs generate a complex electrical field at the electrode assembly. All of the air passing through the space being conditioned by the system, passes through this complex electrical excitation field during primary and secondary air cycling. The submicron particles tend to collide and adhere to each other and more rapidly increase their mass. They are then more easily carried by the system air flow back through the return to be captured in the filters or exhausted from the building. The system thereby enhances filtration and removal of airborne particles and gasses thus, reducing contaminants in a conditioned space.

As a result, air purification systems of this type save energy dollars by reducing the need for large amounts of outside air, save initial investment dollars by reducing heating and cooling equipment requirements, saves costs in the day-to-day cleaning of the conditioned space and the cleaning and maintenance of the air handling equipment. Air purification systems of this type also control the contaminants such as offensive dust, smoke and odor and thereby increase human efficiency by restoring fresh, clean air to the interior environment in which we live, work and breathe.

These systems operate effectively with no noise in the conditioned space. They are also out of sight, thus rendering it difficult for anyone to immediately detect interruption in the operation of the purification by the system. To handle this problem, present power generators are equipped with an indicator, such as a light emitting diode, to indicate if the generator itself is turned on and functioning electrically.

But in air purification systems of this type, in which contaminants are subjected to a complex electrical field as part of the purification process, many ambient conditions, system parameters and type of contaminants influence the efficiency and effectiveness of the system. Thus, although the failure of the fixed output power generator itself can be detected, the effective operation of other components of the system and relevant ambient conditions cannot be readily detected. As a consequence, the air purification system can be rendered ineffective; and such can only be detected by the gradual recontamination of the air. During this time, the space reverts to the conditions which prevailed prior to the utilization of the air purification system. Further, inasmuch as a period of time is required before an air purification system of this type can reduce the contaminants to the optimum level, particularly in large installations, any malfunctioning of a part of the system or change in operating conditions may create an impure air quality condition that takes several hours or days to be removed completely, even after such malfunctioning has been noticed and remedied.

It has also been determined, that certain combinations of electrical field characteristics work better than others in removing certain types of contaminates from the air. Thus, it is desirable to be able to pre-select electrical field characteristics and independently of each other to maximize the air purification rate for a particular application. Once the selection has been made, it is then desirable that such characteristics be maintained.

Each optimum electrical field characteristic should be maintained even though the electrode screen assembly itself becomes contaminated or is otherwise subjected to conditions that would affect the electrical characteristics on the electrodes and the associated electrical field.

SUMMARY OF THE INVENTION

One of the objects of the present invention is to provide a self-regulating air purification system and method that subjects air contaminants to a complex electrical field characteristics, such as a DC voltage and an AC voltage and frequency that are pre-selected independently of one another to provide optimum conditions to influence different types of contaminants.

Another object of the present invention is to provide an air purification system having the capability of self-regulating electrical characteristics such as the DC voltage and the AC voltage and frequency applied to the screen independently of one another.

A further object of the invention is to provide a self-regulating air purification system which is relatively inexpensive to maintain.

Additional objects and advantages of the invention will be set forth in part in the description which follows, and in part will be obvious from the description or may be learned by practice of the invention. The objects and advantages of the invention may be realized and obtained by means of the instrumentalities and combinations particularly pointed out in the appended claims.

In accordance with the purpose of the invention, as embodied and broadly described herein, the air purification system of the present invention comprises a power supply having an output for producing a predetermined voltage upon connection to an AC input voltage; variable high DC voltage and high frequency circuit means responsive to the output of the power supply for generating predetermined voltages and frequencies in the kilovolt and kilohertz range; a conductive screen assembly electrically connected to the high voltage and high frequency circuit means and disposed in a path of flowing air for subjecting the air to be purified to an electrical field of predetermined voltage and frequency, the screen assembly constituting an electrical load on the high voltage and high frequency circuit means; and means for varying both the DC voltage and the AC voltage and frequency independently of each other.

In another aspect, the method of the present invention, as embodied and broadly described herein, comprises flowing the air to be purified through a conductive screen assembly, increasing the amplitude of an input voltage for applying a high voltage in the kilovolt range and high frequency in the kilohertz range to the screen assembly to subject the air flowing through the screen to a complex electrical field; adjusting the magnitude of the DC voltage and the AC voltage and frequency independently of each other; detecting the magnitude and frequency of the voltage of the screen assembly; and controlling at least one of the field characteristics of the applied voltage in accordance with the detected voltage.

The accompanying drawings which are incorporated in and constitute a part of this specification, illustrate two embodiments of the invention, and together with the description, serve to explain the principles of the invention.

DESCRIPTION OF THE PREFERRED EMBODIMENTS

Reference will now be made in detail to the present preferred embodiments of the invention, an example of which is illustrated in the accompanying drawings.

Figure 1:
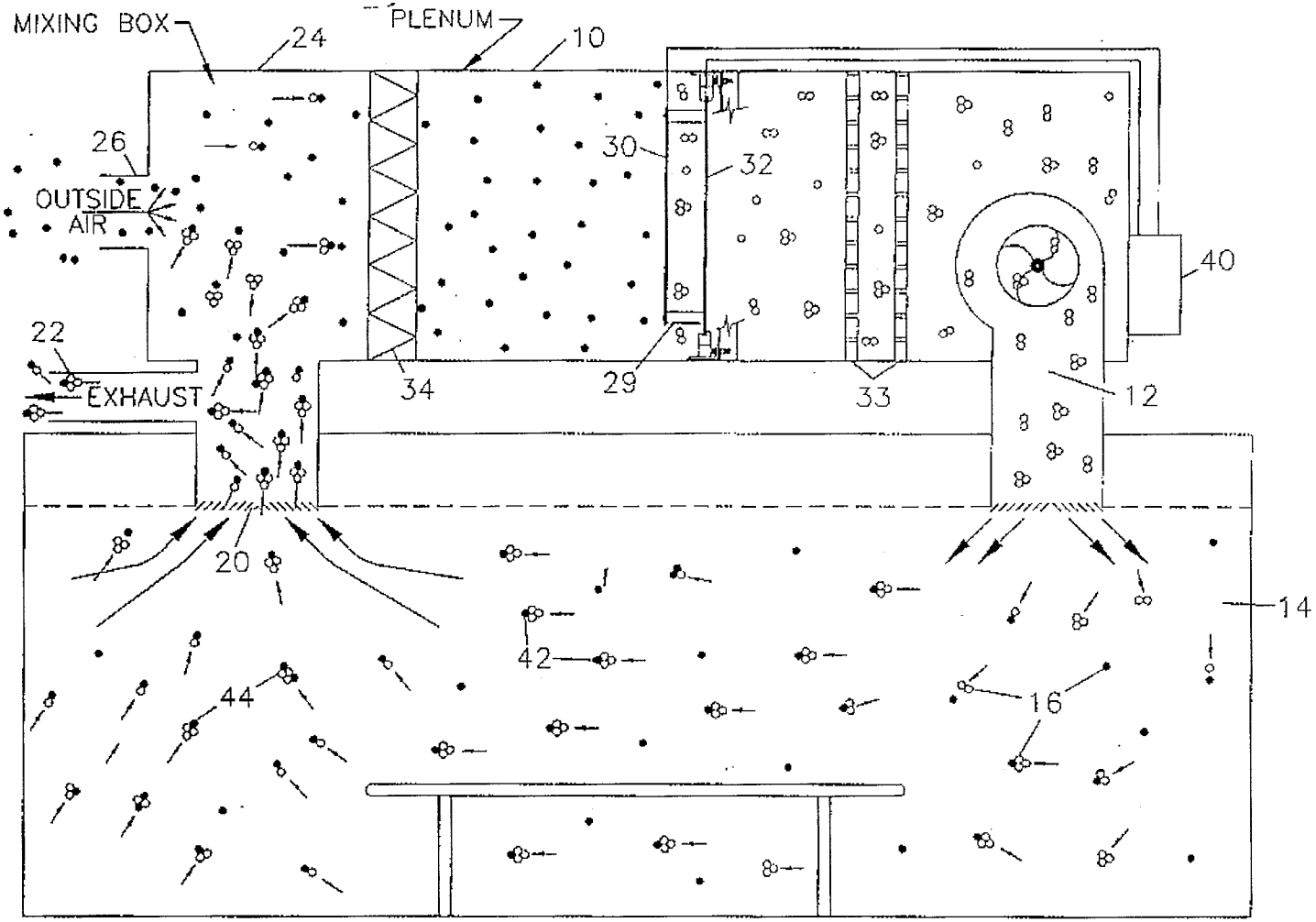
FIG. 1 illustrates one of the arrangements of the individual parts of an air purification system relative to the area being purified, together with a diagrammatic illustration of the airborne contaminants.

Referring to FIG. 1, an air purification system of the present invention preferably, comprises a means for flowing the air to be conditioned or purified. As embodied herein, an air plenum 10 that includes a supply air fan 12 flows the air into a room generally referred to at 14. The flowing air, which includes contaminants such as 16, is flowed along a path and circulated through a passage 20 where a certain portion of the air is exhausted through outlet 22 and another portion of which enters a mixing portion 24 of air plenum 10 which mixes with outside air through inlet 26. In the path of the flowing air is a screen assembly 29. Although the air purification is illustrated and described in connection with a conditioned space having an air plenum, it is understood that the conditioned purified air may make a single pass through the conditioned space or may discharge directly into the atmosphere, as in an exhaust stack or air purge system.

The present invention includes a screen assembly disposed in the path of the air to be treated and electrically connected to a system for creating a complex electrical field from direct current and alternating current inputs. As embodied herein, a screen assembly 29 comprises a high voltage electrode 30 and a high frequency electrode 32. The electrodes 30 and 32 may include movable grids or selectively engaged areas for controlling the degree of treatment. It is understood that the electrodes may also be in the form of conductive wire mesh, rods, braid, or other types of conductors in other geometric configurations.

As illustrated, the system of the present invention may also include an air filter 34 mounted in air plenum 10 upstream of electrodes 30 and 32, with cooling or heating coils 33 mounted in the plenum downstream of electrodes 30 and 32. An air filter may also be mounted downstream of electrodes 30 and 32 in the system prior to discharge into the room 14.

With reference to FIG. 1, as the air passes through the complex electrical field generated at electrodes 30 and 32, smaller particles begin to coalesce or coagulate rapidly as shown between electrode 32 and coils 33. These small particles grow larger and larger as they pass through the conditioned space to the return air duct at passage 20 as indicated, for example, by clusters 42 and 44. In one situation, it was shown that there was a 367% increase in large particle mass with 94% of the particle mass involved removed from the conditioned area. These large particle clusters, such as 42 and 44, are then either exhausted through opening 22 or mixed with dirty untreated outside air entering through inlet 26 into the mixing box 24 and are readily collected by medium or high efficiency filter 34. For most applications, such filters may have an efficiency rating of approximately 55%. In certain specific applications, such as data processing centers, casino's and medical facilities filters 34 may require an efficiency in the neighborhood of 80% or better. The filtered air, which still contains millions of fine particles, then passes through electrodes 30 and 32, and the purification cycle begins again, significantly reducing the airborne dust, smoke, gases and odors in the conditioned space.

Figure 2:
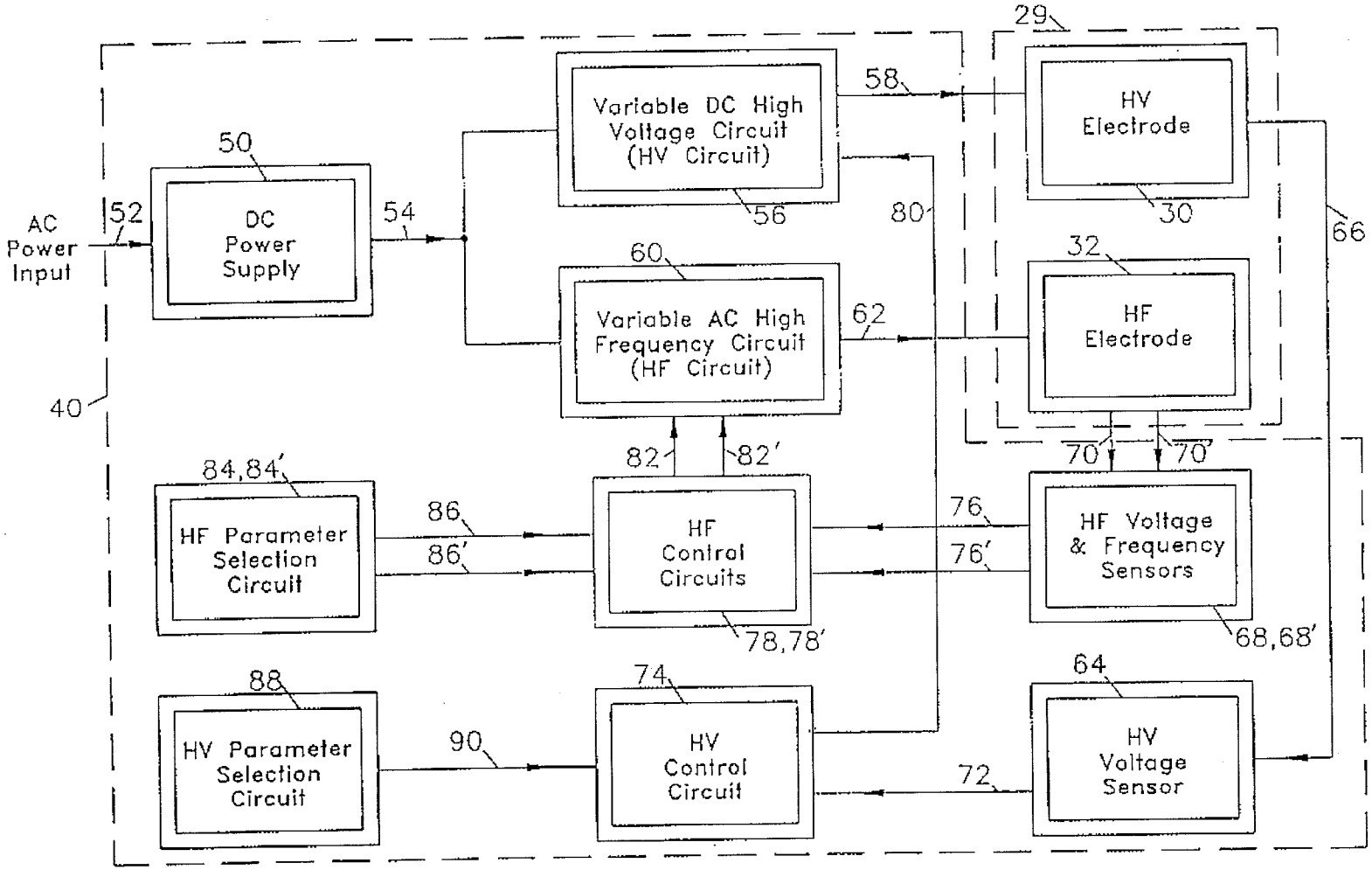
FIG. 2 is a schematic block diagram of a self-regulating system of the present invention capable of maintaining preselected electrical characteristics independently of one another.

Referring to FIG. 2, the air purification system of the present invention, as noted 40, has a DC power supply 50, an AC power input 52, and an output 54 connected to a variable high voltage (HV) DC circuit 56 having an output 58 and a variable high frequency (HF) AC circuit 60 having an output 62. Screen assembly 29, that includes high voltage (HV) electrode 30 and high frequency (HF) electrode 32 as previously described, is connected to output 58 and 62 of circuits 56 and 60 respectively. A high voltage (HV) sensor 64 has an input 66 connected to high voltage (HV) electrode 30; and an AC high (HF) voltage and frequency sensor 68 and 68' and have inputs 70 and 70' connected to high frequency (HF) electrode 32. Output 72 of high voltage sensor 64 is connected to an HV control circuit 74; and outputs 76 and 76' of AC high voltage and frequency sensors 68 and 68' are connected to control circuits 78 and 78'. HV control circuit 74 has an output 80 connected to an input of variable high voltage DC circuit 56; and HF control circuit 78 and 78' have outputs 82 and 82' connected to the inputs of variable high frequency circuit 60. A high voltage (HV) parameter selection circuit 88 has an output 90 connected to control circuit 74. The high frequency (HF) parameter selection circuit 84 and 84' have outputs 86 and 86' connected to control circuits 78 and 78'.

Although FIG. 2 illustrates a system that includes the self-regulation of both the high frequency and high voltage circuits with the parameter selections of each independent of one another; for some applications the system could be advantageously utilized with the self regulation of the high voltage circuit without the self regulation of the high frequency circuit or vice versa.

Once the set point is obtained, the complex electrical field is optimized for a particular contaminant or contaminants, it is desirable to maintain that condition, however environmental factors such as temperature, humidity and concentration or type of contaminant may change, causing the complex electrical field's effectiveness to diminish. The objective of the invention is to compensate for the environmental factors and thereby maintain optimum efficiency.

Figure 3A:
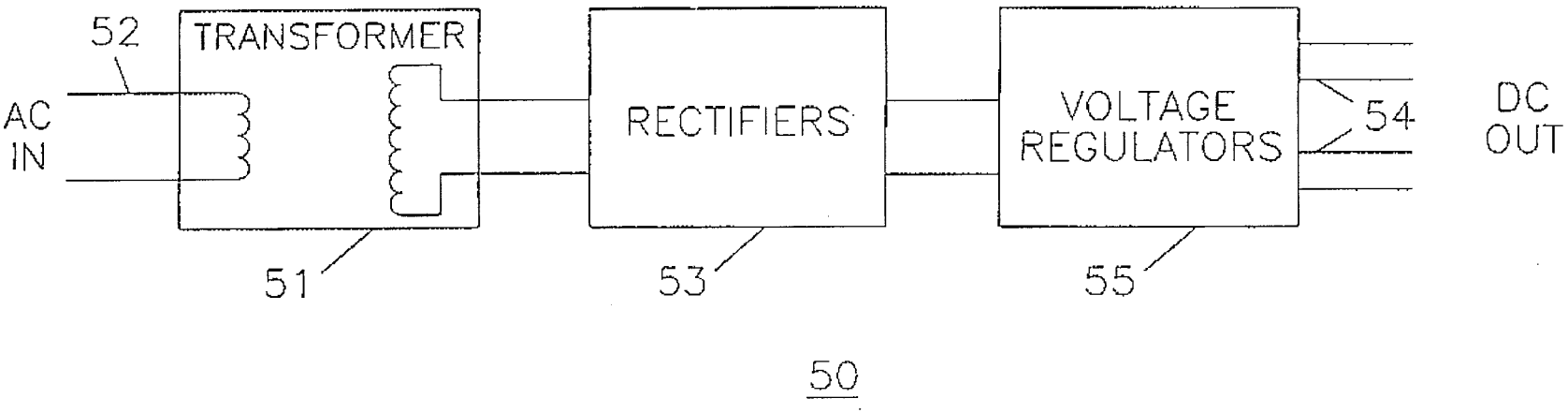
FIG. 3A is a block diagram of the DC power supply for the system.

The system of the present invention comprises a power supply having an output for producing a DC voltage with a predetermined amplitude upon connection to an AC input. As embodied herein and referring to FIG. 3A, power supply 50 has an input transformer 51 to set the proper AC voltage levels. Power supply 50 also includes rectifiers 53 and voltage regulators 55 to produce the proper DC levels for operation of the HV, HF, and control circuitry.

Figure 3B:
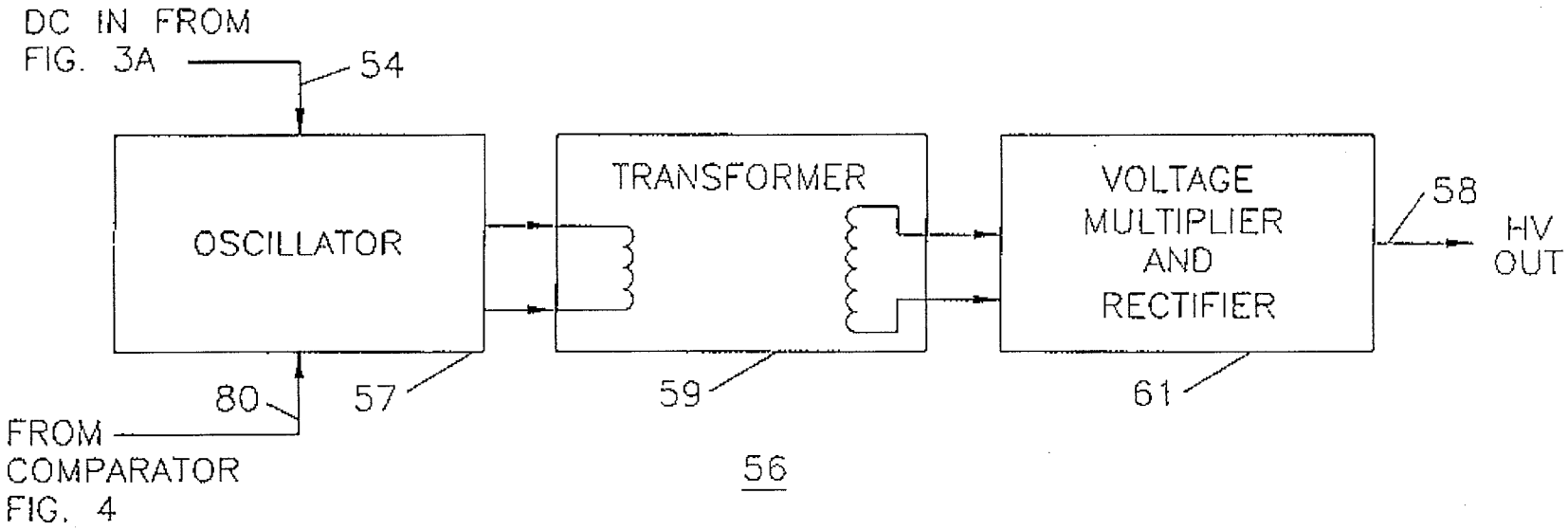
FIG. 3B is a block diagram of an exemplary adjustable HV module.

In accordance with the present invention, a variable high voltage circuit is electrically coupled to the power supply for generating a variable DC high voltage in the kilovolt range. As embodied herein and shown in FIG. 3B, high voltage circuit 56 has an oscillator 57, a transformer 59 and a voltage multiplier and rectifier 61. The oscillator, being a primary signal source, produces a voltage which is transformed to the proper AC level by the transformer. The voltage multiplier takes the output of the transformer, shifts the level by the proper multiple, and changes the AC to a DC voltage. This voltage is in the DC kilovolt range or, in other words, in the range of about one kilovolt to nine hundred ninety-nine kilovolts, and is applied to the HV electrode 30.

Figure 3C:
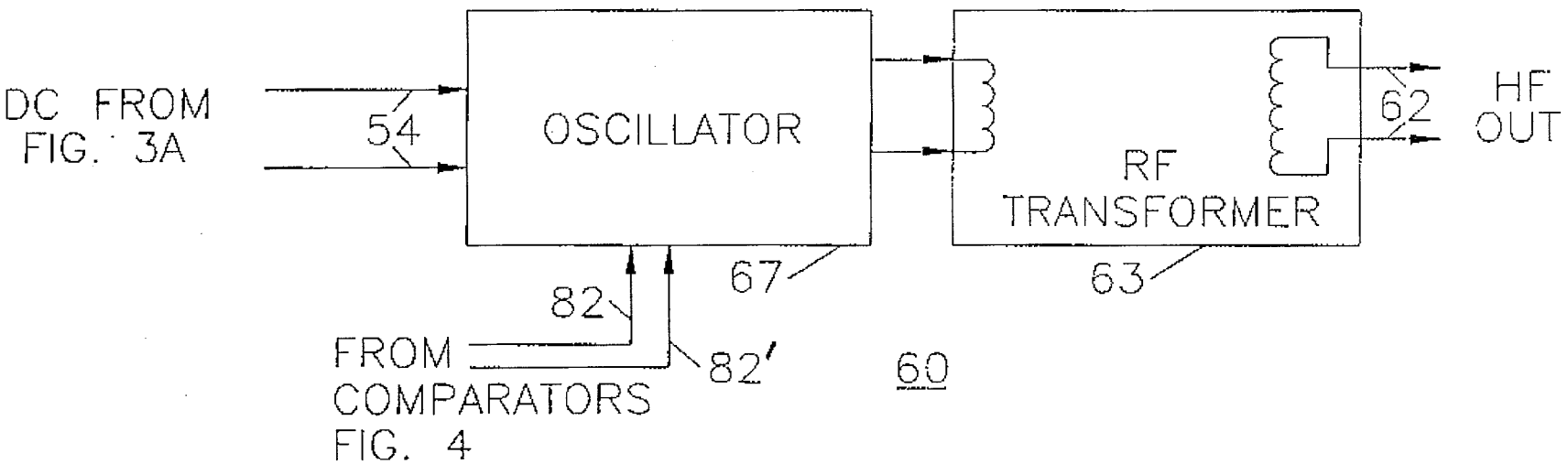
FIG. 3C is a block diagram of the adjustable HF module.

In accordance with the present invention, a variable high frequency circuit is electrically coupled to the power supply for generating a high frequency output in the kilohertz range. As embodied herein and referring to FIG. 3C, high frequency circuit 60 has an oscillator 67 and a transformer 63 capable of operating in the RF range of frequencies. The oscillator, being a primary signal source, produces a voltage. This voltage is coupled to the transformer which raises the voltage to the proper AC level. This voltage is in the range of hundreds of volts RMS or, in other words, in the range of about one hundred to nine hundred volts at a frequency in the kilohertz range or, in other words, in the range of about on kilohertz to nine hundred ninety-nine kilohertz. This voltage is applied to the HF electrode 32.

Thus, the variable high frequency circuit 60 and the variable high voltage circuit 56 have similar components and function. It should be noted that the secondary winding of the transformer and the capacitive load represented by the screen assembly 29 form a tuned circuit, the impedance of which is frequency dependent. If the operating frequency of the circuit 60 is adjusted to be close to the resonant frequency, the current in the primary winding of corresponding transformer 63 is low. However, it increases rapidly as the operating frequency moves from resonance. Thus, the output voltage of circuit 60 is dependent upon the operating frequency of the corresponding oscillator 67. The output voltage on 62 peaks when the corresponding circuit 60 is operating at resonance, and will decrease as the oscillator frequency moves away from resonance. A current limiting regulator (not shown) is provided to limit the current to an acceptable maximum value under off design conditions which can occur during start-up, or if the frequency is improperly adjusted.

As previously mentioned, the conductive screen assembly 29 is electrically connected to the high voltage circuit 56 by line 58, and the high frequency circuit 60 by line 62, and disposed in the path of the flowing air to subject the air to be purified to a complex electrical field having a predetermined high voltage and high frequency applied. The screen assembly 29 constitutes a capacitive load on the high voltage circuit 56 and high frequency circuit 60.

In accordance with the invention, one embodiment has a high voltage sensor coupled to the screen assembly for outputting a voltage having an amplitude corresponding to the voltage imposed on the screen assembly by the high voltage circuit and HF voltage and frequency sensors for outputting a voltage having an amplitude corresponding to the RMS voltage and frequency of the HF electrode of the screen assembly. As herein embodied, a voltage sensor 64 is connected to the high voltage (HV) screen 30, HF voltage and frequency sensors 68, and 68' respectively are connected to HF screen 32.

The system of the present invention includes a voltage control circuit connecting the variable DC high voltage circuit to the HV voltage sensor. In this way, it is possible to maintain a constant predetermined level of the complex electrical field at the screens. As herein embodied and referring to FIG. 4 an analog system in accordance with the present invention is described. The HV control circuit, produces an output voltage on line 80 for controlling the frequency of oscillator 57 in HV circuit 56.

The output of the sensor 64 is a voltage level that is proportional to the level of voltage on the HV electrode 30. This voltage level on line 72 is compared to a reference voltage level (set point) on line 90 by the HV control circuit 74. The output of HV control circuit 74 on line 80 is an error signal which represents the difference between the actual electrode voltage on screen 30 and the desired electrode voltage. The output of the HV control circuit 74 on line 80 is an input to the high voltage DC circuit 56 shown in FIG. 3B. The amount of error voltage input to the high voltage circuit 56 will adjust the output voltage level of the oscillator 57 which will determine the voltage level applied to the HV electrode 30. In this way, the HV electrode voltage will be kept at the desired level.

The system of the present invention also includes HF control circuits 78 and 78' connecting the variable AC high frequency circuit 60 to the HF sensors 68 and 68' for varying the frequency and amplitude of the voltage applied to electrode 32 of screen assembly 29 in accordance with the frequency and amplitude of the output voltage of sensors 68 and 68' respectively, to maintain a constant predetermined frequency and amplitude of the complex electrical field.

Figure 4:
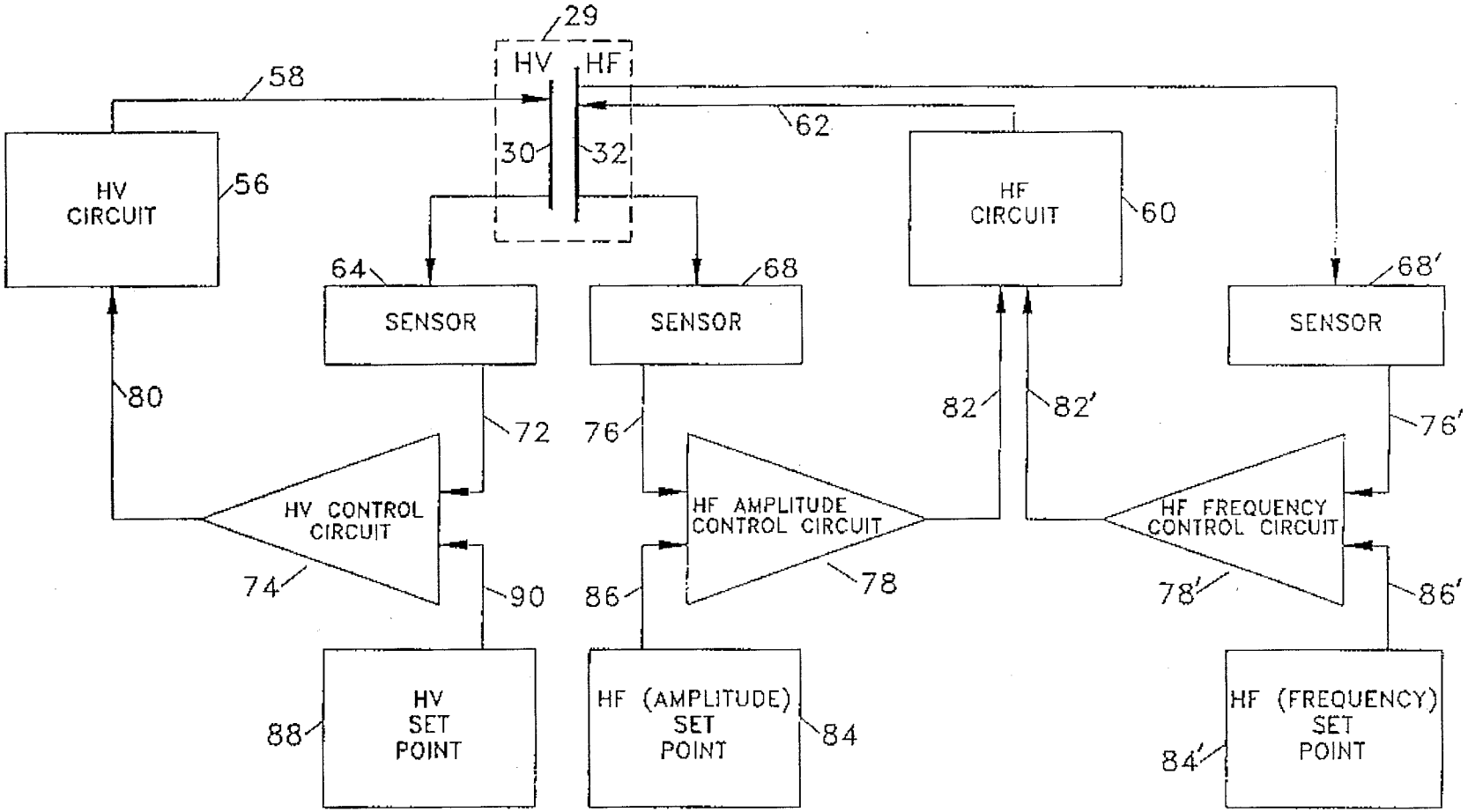
FIG. 4 is a block diagram of an analog implementation of the system.

HF voltage and frequency sensors 68 and 68' are coupled to the screen assembly for outputting a voltage having an amplitude corresponding to the frequency and amplitude imposed on the screen assembly by HF circuit 60. As shown in FIG. 4, the output of the HF amplitude sensor 68 is a voltage level that is proportional to the amplitude of the voltage on HF electrode 32. This voltage level on line 76 is compared to a reference voltage level (set point) by an HF amplitude control circuit 78. The output of the HF amplitude control circuit 78 on line 82 is an error signal which represents the difference between the actual electrode voltage amplitude and the desired electrode voltage amplitude.

The output of the HF frequency sensor 68' is a voltage level proportional to the frequency of the voltage on HF electrode 32. This voltage level on line 76' is compared to a reference voltage level (set point) by the HF frequency control circuit 78'. The output of the HF frequency control circuit 78' on line 82' is an error signal which represents the difference between the actual electrode voltage frequency and the desired electrode voltage frequency.

Referring again to FIGS. 2 and 4, HF amplitude parameter selection circuit 84 has an output 86 for connecting an output voltage corresponding to a reference or set point voltage for comparison with the corresponding sensed voltage from the HF voltage sensor 68 of electrode 32. HF frequency parameter selection circuit 84' has an output 86' for connecting an output voltage corresponding to a reference or set point voltage for comparison with the corresponding sensed voltage from the HF frequency sensor 68' of electrode 32. The parameter selection circuit 84 provides a set point on 86 for setting the desired amplitude set point for the AC voltage of electrode 32 and circuit 84' provides a set point on 86' for setting the desired frequency of the AC voltage of electrode 32. HV parameter selection circuit 88 has an output 90 for connecting an output voltage corresponding to a reference or set point voltage for comparison with the corresponding sensed voltage from the HV sensor 64. The setpoints of the parameter selection circuits 88, 84 and 84' are independently adjustable. The circuits 88 and 84 and 84' can provide for manually adjustable set points.

Several means can be used to select the HF and HV set points. For example, a microprocessor could be used. An additional concept would involve using a sensing device in the air stream which would sense the presence of certain contaminants, and then make adjustment to the power supply to maximize the efficiency of the unit for each of these particular contaminants. Voltage levels could also be adjusted to follow airflow rates in the duct, for example.

Figure 5:
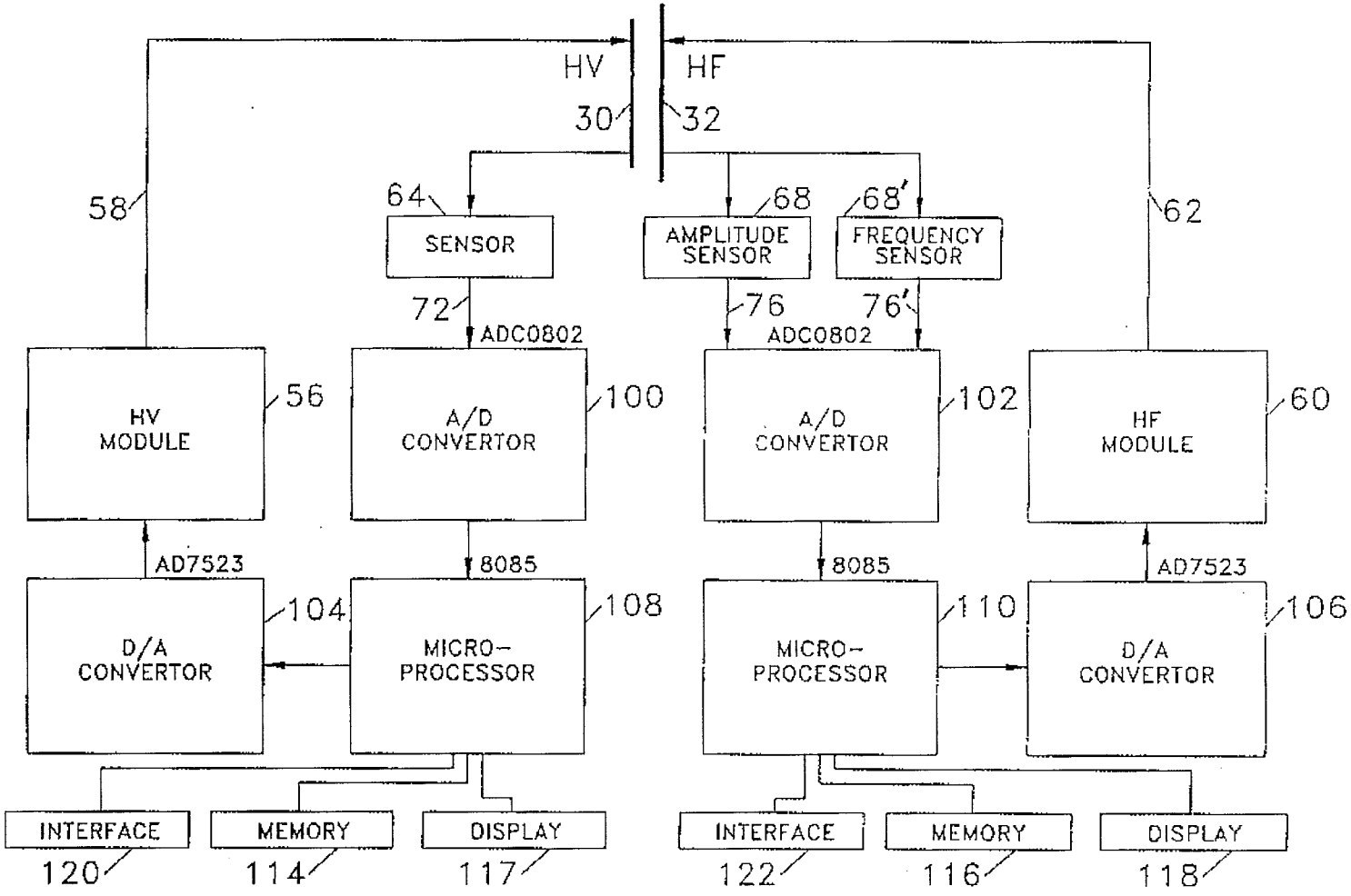
FIG. 5 is a block diagram of a digital/microprocessor implementation of the system.

Referring to FIG. 5, a digital implementation of the system of the present invention comprises an HV sensor 64, an amplitude sensor 68 and a frequency sensor 68', electrically coupled to HV electrode 30 and HF electrode 32. An HV module 56 and an HF module 60 are connected to electrode 30 and 32 respectively for providing a variable DC and variable AC voltage to the electrodes similar to the previously described embodiment. The system further includes an A/D converter 100 connected to the output of sensor 64, and an A/D converter 102 connected to the outputs of sensors 68 and 68'. A D/A converter 104 has an output connected to the input of HV module 56. A microprocessor 108 has an input connected to the A/D converter 100 and an output connected to the D/A converter 104. A microprocessor 110 has an input connected to the A/D converter 102 and an output connected to the D/A converter 106.

Referring again to FIG. 5, the HV and HF electrodes are located in the air stream for the purpose of creating a complex electrical field. The complex electrical field is detected by the sensors 64, 68 and 68'. A/D converters 100 and 102 each produce a digital signal. The digital signal from A/D converter 100 is proportional to the DC level of the voltage on the HV electrode 30, and the digital signal from the A/D converter 102 is proportional to the AC frequency and amplitude of the signal on the HF electrode 32. The digital signals are each applied to an input port of a respective microprocessor 108 and 110. The inputs are processed by the corresponding microprocessor using instructions which are stored in memory units 114 and 116 (RAM and ROM) which are also interfaced to the respective microprocessor. Each microprocessor outputs information to separate display circuitry 117 and 118, interface circuitry (RS-232, etc.) 120 and 122, and to two separate D/A converters 104 and 106. D/A converter 104 is connected to HV module 56 which is a high voltage generator capable of producing a DC voltage in the kilovolt range. The output of this D/A converter 104 will control the amount of voltage produced by the high voltage DC generator, the output of which is connected to the HV electrode 30. The output of the D/A converter 106 will control the frequency and amplitude of the AC voltage, produced by the high voltage AC generator, which is connected to the HF electrode 32.

Figure 6:
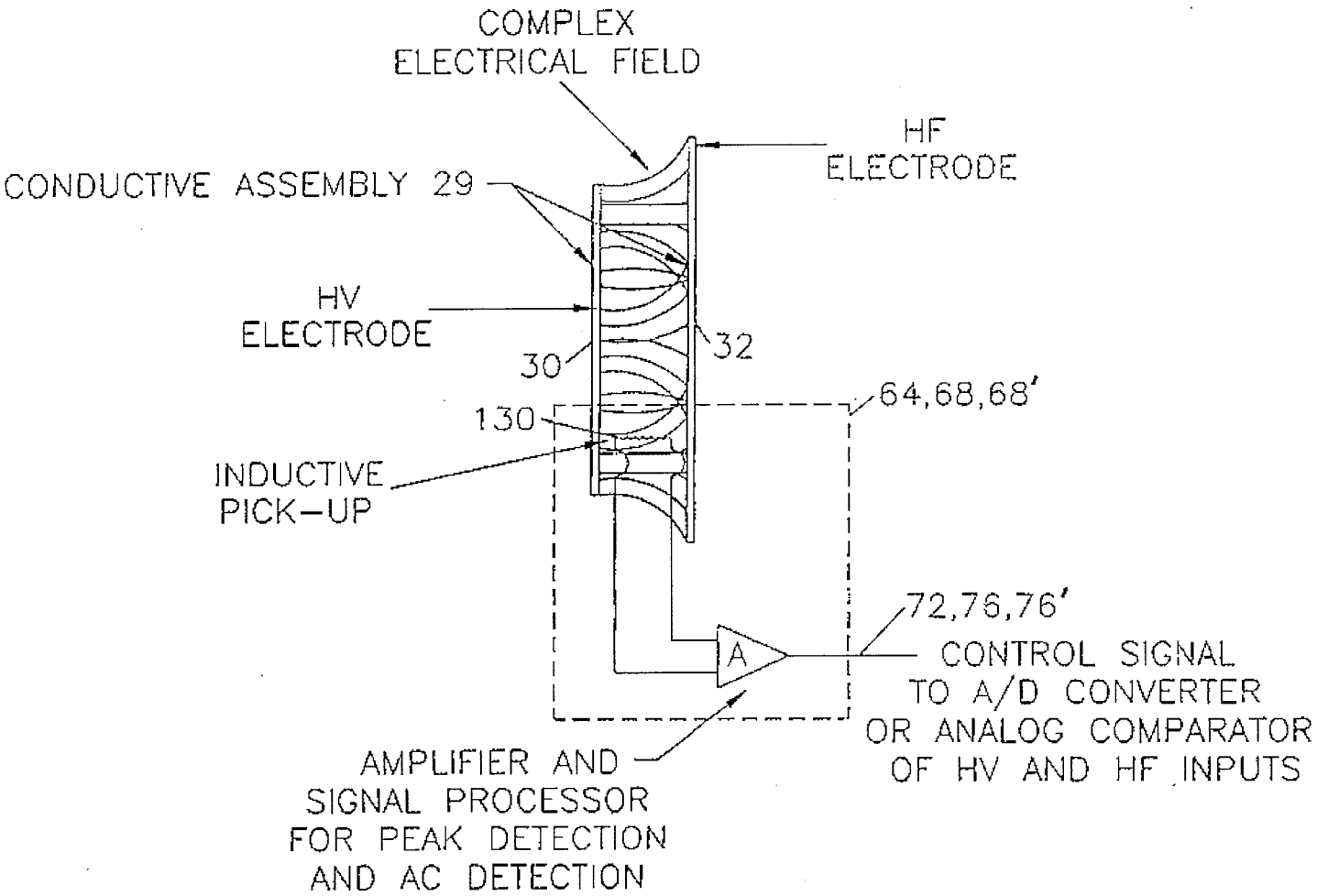
FIG. 6 is an illustration of the inductive sensing means.

FIG. 6 shows an alternate apparatus for sensing the amplitude and frequency of the complex electromagnetic field associated with electrodes 30 and 32. In this embodiment an inductive pick-up coil 130 disposed in the complex electrical field created by electrodes 30 and 32 of the screen assembly 29, replaces sensors 64, 68 and 68'. The inductive pick-up coil will sense the lines of force generated by the electrical field. These lines of force are proportional to the magnitude and frequency of the electrical field generated by the screen assembly 29. The lines of force will induce a voltage into the inductive pick-up which may be connected to any well known amplifier and signal processor for detecting the RMS value, frequency and peak electrical strength of the field. These signals are then output to a comparator for an analog system or an A/D converter for the digital system. Although three separate sensors are shown and described in connection with FIGS. 4, it is to be understood that a single inductive pick-up coil may be used to detect the effect of the DC voltage, and AC amplitude and frequency for the HV and HF circuits, respectively.

It will be apparent to those skilled in the art that various modifications and variations can be made in the air purification system of the present invention without departing from the spirit or scope of the appended claims. Thus, it is intended that the present invention covers the modifications and variations of this invention provided they come within the scope of the appended claims and their equivalents.

What we claim is:

1. A method of purifying air, comprising:

flowing air through a conductive assembly to subject the air to be purified to a complex electrical field having a predetermined magnitude and frequency;

applying a high frequency AC voltage in the kilohertz range to the conductive assembly;

dividing the voltage in the conductive assembly to a predetermined fraction;

generating control voltage corresponding to the divided voltage; and varying the voltage applied to the conductive assembly in accordance with the control voltage for maintaining a constant predetermined frequency of the electrical field.

2. A method of purifying the air, comprising:

flowing air through a conductive assembly to subject the air to a complex electrical field having a predetermined magnitude;

applying a high voltage in the kilovolt range to the conductive assembly;

dividing the voltage of the conductive assembly to a predetermined fraction;

generating a control voltage having a level in accordance with the divided voltage; and varying the applied voltage to the conductive assembly in accordance with the level of the control voltage to maintain a constant predetermined magnitude of the electrical field.

3. A method of purifying air, comprising:

generating a DC voltage in the kilovolt range;

generating an AC voltage in the hundreds of volts RMS range and having a frequency in the kilohertz range;

applying a load to the generated AC and DC voltages in the form of a complex electrical field;

flowing the air to be purified through the complex electrical field;

sensing the amplitude of the AC voltage, the frequency of the AC voltage, and the amplitude of the DC voltage applied to the load during the flowing of the air;

varying the amplitude of the sensed AC voltage independent of the sensed frequency and sensed DC voltage to maintain a constant HF amplitude component of the complex electrical field;

varying the frequency of the sensed AC voltage independent of the sensed AC and DC voltage amplitudes to maintain a constant frequency of the complex electrical field; and varying the sensed DC voltage independent of the sensed frequency and amplitude of the AC voltage to maintain a constant voltage of the complex electrical field.

4. The method of claim 3 wherein the step of generating the DC voltage, comprises:

multiplying the voltage applied to the load in accordance with a transformer secondary winding output;

oscillating the voltage applied to a primary winding of a transformer to control the flow of current in the primary winding of a transformer at a rate corresponding to the voltage applied to the voltage multiplier via said secondary winding.

5. The method of claim 4 wherein the step of generating the DC voltage comprises:

rectifying an AC input voltage.

6. A method of purifying air, comprising:

generating an AC voltage in the hundreds of volts RMS range and having a frequency in the kilohertz range;

applying the generated AC voltage to a conductive assembly to generate a complex electrical field;

flowing the air to the purified through the complex electrical field;

sensing the amplitude of the AC voltage and the frequency of the AC voltage;

varying the amplitude of the sensed AC voltage and the sensed frequency to maintain a constant HF amplitude component of the complex electrical field; and selecting a desired frequency and amplitude applied to the load.

7. The method of claim 6 wherein the step of applying the generated AC voltage comprises:

applying a voltage from a secondary winding of a transformer to the conductive assembly;

oscillating the voltage to control the flow of current in a primary winding of the transformer; and determining the frequency of the voltage applied to the conductive assembly in accordance with the flow of current in the primary winding of the transformer.

8. The method of claim 7 further comprising:

determining the amplitude of the voltage applied to the conductive assembly in accordance with the flow of current in the primary winding of the transformer.

9. The method of claim 6 wherein the step of generating an AC voltage, comprises:

rectifying an AC voltage to produce a DC voltage, and oscillating the DC voltage.

* * * * *